US009044687B2

(12) United States Patent
Walker

(10) Patent No.: US 9,044,687 B2
(45) Date of Patent: Jun. 2, 2015

(54) RALLY TOWEL APPARATUS

(71) Applicant: Charles Walker, Oxford, MI (US)

(72) Inventor: Charles Walker, Oxford, MI (US)

( * ) Notice: Subject to any disclaimer, the term of this patent is extended or adjusted under 35 U.S.C. 154(b) by 112 days.

(21) Appl. No.: 13/738,049

(22) Filed: Jan. 10, 2013

(65) Prior Publication Data

US 2013/0180083 A1 Jul. 18, 2013

Related U.S. Application Data

(60) Provisional application No. 61/632,013, filed on Jan. 17, 2012.

(51) Int. Cl.
*G09F 3/18* (2006.01)
*A63H 37/00* (2006.01)

(52) U.S. Cl.
CPC ..... *A63H 37/00* (2013.01); *Y10T 16/4724* (2013.01)

(58) Field of Classification Search
CPC ..... A63B 5/20; G09F 17/00
USPC ..... 40/218; 482/82
See application file for complete search history.

(56) References Cited

U.S. PATENT DOCUMENTS 2,572,889 A * 10/1951 Strykower ..... 224/258
2,723,121 A * 11/1955 Cartwright et al. ..... 482/82
3,395,577 A * 8/1968 Melville ..... 73/170.03
3,995,872 A * 12/1976 Joseph ..... 280/822
4,201,382 A * 5/1980 Wilson ..... 482/82
4,322,077 A * 3/1982 Van't Hof ..... 473/551
4,385,759 A * 5/1983 Everroad ..... 482/82
4,489,934 A * 12/1984 Miller ..... 482/82
4,593,903 A * 6/1986 Waitz ..... 482/93
4,720,204 A * 1/1988 Johnson ..... 403/24
4,801,137 A * 1/1989 Douglass ..... 482/82
4,934,691 A * 6/1990 Rudd ..... 482/82
4,958,758 A * 9/1990 Tipple et al. ..... 224/267
5,054,772 A * 10/1991 Winston ..... 482/82
5,307,966 A * 5/1994 Inaba et al. ..... 224/578
5,618,040 A * 4/1997 Parten ..... 473/461
5,620,397 A * 4/1997 Chieh ..... 482/46
5,904,116 A * 5/1999 Wyner et al. ..... 116/173
6,216,319 B1 * 4/2001 Elkins ..... 24/3.2
6,487,756 B1 * 12/2002 Vidal, Jr. ..... 24/3.1
6,929,209 B2 * 8/2005 Baumgarten ..... 242/377
6,971,963 B2 * 12/2005 Abel ..... 473/508
7,665,412 B2 * 2/2010 Walls ..... 116/173
7,698,823 B1 * 4/2010 Iadarola ..... 30/537
7,942,108 B2 * 5/2011 Sherrod ..... 116/173
8,043,196 B1 * 10/2011 Chen ..... 482/82
8,062,193 B2 * 11/2011 Oesterling ..... 482/82
8,082,687 B2 * 12/2011 Cohen ..... 40/218
8,136,209 B1 * 3/2012 Willison ..... 16/430
2003/0213156 A1 * 11/2003 Gregory ..... 40/661
2007/0087868 A1 * 4/2007 Williams ..... 473/464
2011/0028065 A1 * 2/2011 Arcovio ..... 446/242
2011/0306474 A1 * 12/2011 Gamboa et al. ..... 482/81
2013/0047911 A1 * 2/2013 Rasmus ..... 116/173
2013/0205625 A1 * 8/2013 Pilok ..... 40/218

* cited by examiner

*Primary Examiner* — Shin Kim
(74) *Attorney, Agent, or Firm* — Aldenbaum Schloff and Bloom PLLC; Jay Schloff; Keith Schonberger

(57) ABSTRACT

A rally towel apparatus comprising a body having first end and a second end. The rally towel apparatus also comprises a first end cap engaged with a first end and a second end cap engaged with a second end. The rally towel apparatus also comprises a cord connected to the first end cap and a cord lock member arranged on the cord. The rally towel apparatus also comprises a wrist strap connected to the second end cap and a rally towel arranged and secured within a loop of the cord.

18 Claims, 3 Drawing Sheets

FIG. 1

RALLY TOWEL APPARATUS

This application claims the benefit of U.S. Provisional Patent Application 61/632,013 filed Jan. 17, 2012

BACKGROUND OF THE INVENTION

1. Field of the Invention

The present invention generally relates to a rally towel and more particularly relates to a rally towel apparatus, wherein the user holds onto the handle of a rally towel apparatus when rallying a team by twirling a fan rally towel.

2. Description of Related Art

The rally towel has been known for numerous years in the sports fan industry. Rally towels are either purchased by a fan of a team or provided by teams to their fans in order to create interactive ways for fans to cheer on a specific team during a game or match. A sports team rally towel generally may include the logo of the team, inspirational sayings and/or any known colors associated with the team to which the rally towel is associated. The rally towel generally is held by one corner by the fan and rotated in a twirling motion. This may create a visual distraction to the opposing team when the entire crowd is twirling or shaking a rally towel. The rally towel can come in any shape or size such as rectangular, square, circular or any other known shape. One problem with rally towels in the prior art is that they often times are bulky to carry, are easily misplaced, dropped on the floor or lost between seats or other fixtures within the arenas in which the fans are located. Furthermore, some fans in their overzealousness for a particular team may shake or rotate their rally towel and have it fly out of their hand and away from them towards other persons or objects within the arena environment.

Therefore, there is a need in the art for an improved sports fan rally towel holding apparatus. There is also a need in the art for a fan rally towel carrying device that will allow for a rally towel to be clipped easily onto a pocket or purse string in order to hold and display the rally towel on the user and may also come with an attached wrist strap to ensure the rally towel and associated holder do not go flying during use of the rally towel by the sports fan. There also is a need in the art for a lightweight easy to use rally towel holder that is capable of being customized to each individual team to which the rally towel and associated rally towel holding apparatus is associated with.

SUMMARY OF THE INVENTION

One object of the present invention maybe to provide a novel and unique rally towel apparatus.

Another object of the present invention maybe to provide a rally towel apparatus that is capable of both being used as a carrying device and a holder for a sports fan rally towel.

Yet another object of the present invention maybe to provide a rally towel apparatus that clips easily onto a pocket, belt or purse string for holding the rally towel thereon.

Another object of the present invention maybe to provide a rally towel apparatus that has an attachable wrist strap thereon in order to secure the rally towel apparatus to the sports fan using the rally towel.

Another object of the present invention maybe to provide a rally towel apparatus that the fan or user holds onto and rallys the team by twirling the rally towel.

Still another object of the present invention maybe to provide a rally towel apparatus that allows for the body or handle to have a logo or insignia thereon for marketing purposes and to increase the appeal of the apparatus to the consumer.

Another object of the present invention maybe to provide a rally towel apparatus that has any number of color schemes, stickers or logos arranged thereon to appeal to a wide range of sports fan rally towel owners including sports fans around the world at many different sporting venues.

Another object of the present invention maybe to provide a rally towel apparatus that may allow fans of various teams to easily carry, display, and twirl the rally towels to show their team pride and rally on their team in new and exciting ways.

Still another object of the present invention maybe to provide a rally towel apparatus that may be marketed to sports fans around the world to be used in any venue from schools to professional sporting events and may be sold in stores, online and at sporting events around the world.

According to the present invention, the foregoing and other objects and advantages are obtained by a novel design for a fan rally towel apparatus comprising a body having a first end and a second end wherein a first end cap is engaged with the first end. The apparatus also comprises a second end cap that engages with the second end and a cord connected to the first end cap. The apparatus further comprises a cord lock member arranged on the cord and a wrist strap connected to the second end cap. The apparatus also comprises a rally towel arranged and secured within a loop of the cord.

One advantage of the present invention may be that it provides a novel and unique rally towel apparatus.

Another advantage of the present invention maybe that it provides for a rally towel apparatus to be used as a holding device and a holder for a sports fan rally towel.

Another advantage of the present invention maybe that it provides for a rally towel apparatus that could easily clip to a pocket, belt or purse string to hold and display the rally towel.

Yet another advantage of the present invention maybe that it provides for a rally towel apparatus that has an attached wrist strap to be placed around the wrist of the sports fan user thus insuring a rally towel does not fly in an unwanted direction.

Still another advantage of the present invention maybe that it provides for a rally towel apparatus that has a body or handle that allows the user to hold onto when rallying the team by twirling a fan rally towel.

Yet another advantage of the present invention maybe that it provides for a rally towel apparatus that may allow the seller of the apparatus to place a logo or insignia for the team or other marketing material thereon thus increasing the appeal of the device for the consumer.

Another advantage of the present invention maybe that it provides for a rally towel apparatus that may have any variety or number of color schemes, stickers, logos or other marks thereon to appeal to a wide range of sports fan rally towel owners.

Another advantage of the present invention maybe that it provides for a rally towel apparatus that may be used around the world at many different sporting venues, such that fans can easily carry, display and twirl their towels to show there team pride while rallying their team in a new and exciting way.

Yet another advantage of the present invention maybe that it provides for a rally towel apparatus that may be capable of being marketed to sports fans around the world, could be used in any venue from schools to professional sporting events and could be sold in stores, online or at sporting events around the world.

Other objects, features and advantages of the present invention will become apparent from the subsequent description, and appended claims, taken in conjunction with the accompanying drawings.

BRIEF DESCRIPTION OF THE EMBODIMENT(S)

Figure 1:
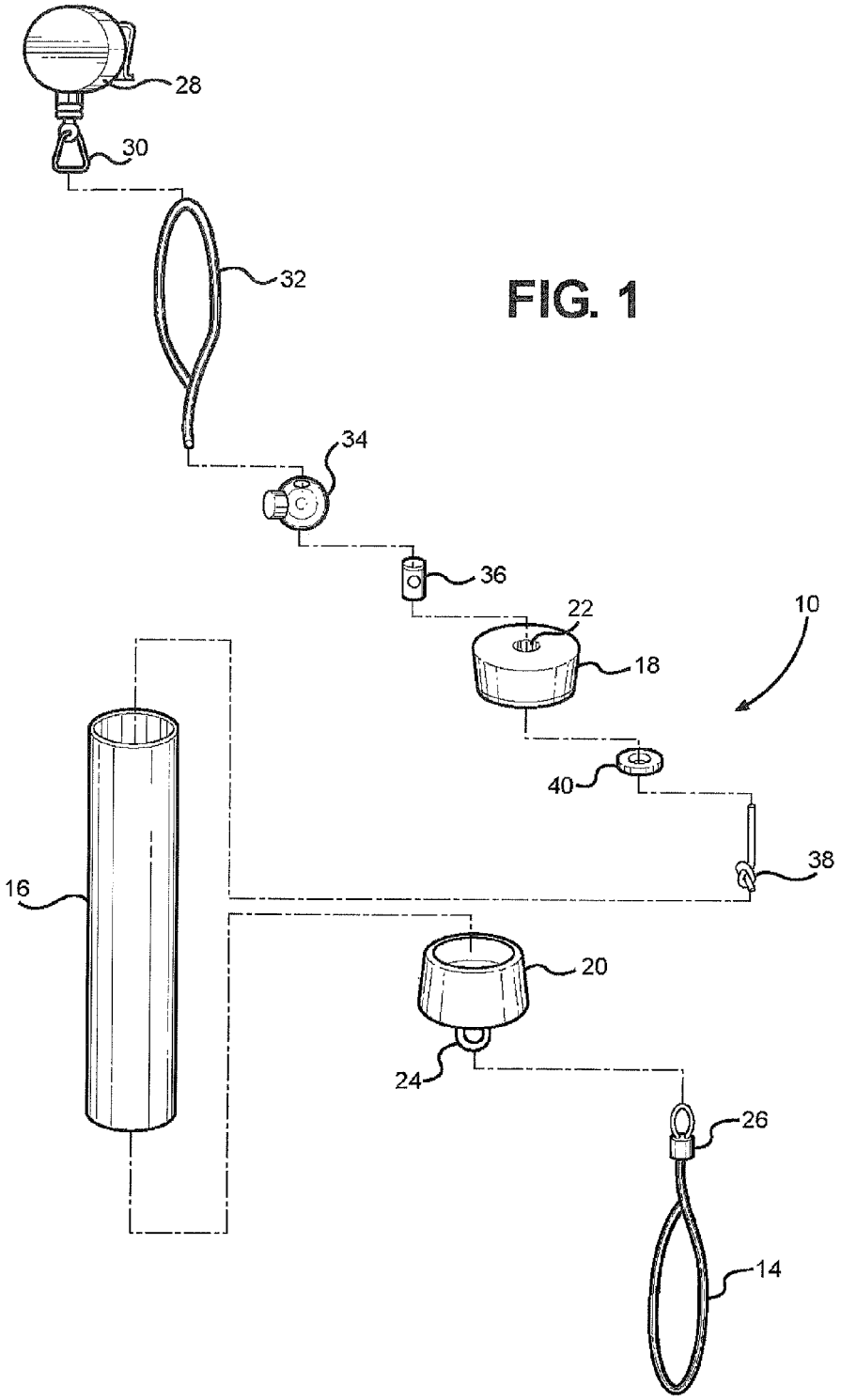
FIG. 1 shows an exploded view of a rally towel apparatus according to the present invention.
Figure 2:
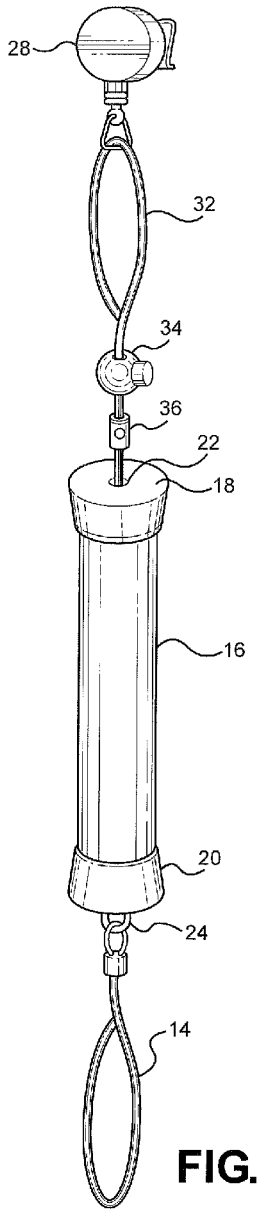
FIG. 2 shows a perspective view of a rally towel apparatus according to the present invention.
Figure 3:
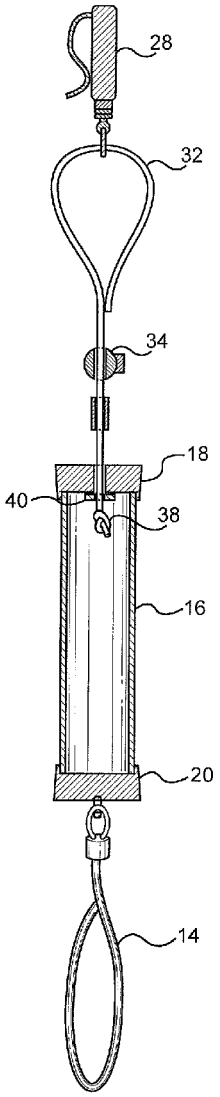
FIG. 3 shows a cross sectional view of a rally towel apparatus according to the present invention.
Figure 4:
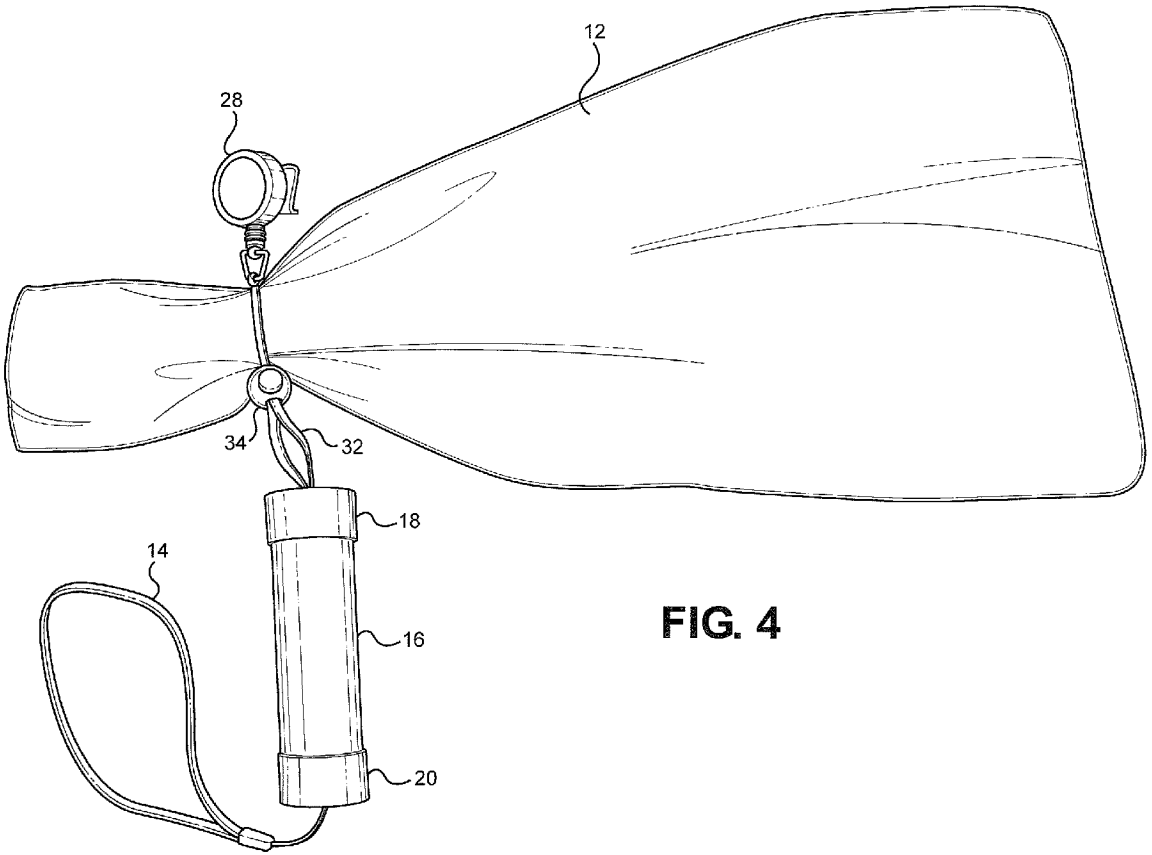
FIG. 4 shows a rally towel inserted into and being held by the rally towel apparatus according to the present invention.

Referring to the drawings, a rally towel apparatus 10 which is a fun device to twirl a sports fan rally towel 12 is disclosed. The rally towel apparatus 10 may be used as a carrying device and holder for a sports fan rally towel 12. It should be noted that the rally towel apparatus 10 may clip easily onto a pocket, belt or purse string of a person to hold and display the rally towel 12 and also may come with an attached wrist strap 14 to ensure the rally towel apparatus 10 is not dropped or lost during use at a sporting event.

The rally towel apparatus 10 generally may be made of plastic, metal, or natural materials. It should be noted that it is also contemplated to have the rally towel apparatus 10 and all associated components made of any known material such as metal, ceramic, plastic, composite, or any other natural or man made material and not just the plastic, metal or natural material described herein and in the drawings. The rally towel apparatus 10 includes a body or holder 16 having a tube like shape. However, it should noted that any other known shape may be used for the body 16 of the rally towel apparatus 10 such as a square cross section, a rectangular cross section, any other known cross section or any other shape that is capable of being held by the user of the rally towel 12 and the rally towel apparatus 10. The body or holder 16 is what the user may hold onto when rallying their team by twirling their team rally towel 12 in an area over their head or in front of their body. The body 16 also may allow for the seller of the product to place their logo, insignia, or other markings thereon for team identification purposes and to increase the appeal of the device to the consumer of the rally towel 12. It should be noted that the body 16 may have any known length or diameter however in one contemplated embodiment the rally towel apparatus 10 has an approximate length of five inches and an approximate diameter of one inch. It should be noted that any known length from two inches to sixty inches may be used and any known diameter or width from a quarter inch to twelve inches may be used for the rally towel apparatus body 16. It should further be noted that the outer surface of the body 16 may include a grip feature that allows for a more ergonomical fit to the hand of the user of the rally towel apparatus 10. It may also be coated in a more ascetically pleasing outer surface such as a rubber or neoprene surface to create a more comfortable grip for the rally towel apparatus 10 user. The body 16 generally may have an inner bore such as found in many tubes and cylinders, which may be capable of being used as a storage area if a first end cap and/or a second end cap on each end thereof are capable of being removed from the body 16 of the rally towel apparatus 10.

The rally towel apparatus 10 also includes a first end cap 18 and a second end cap 20 arranged on a first and second end, respectively, of the body 16. The first end cap 18 generally has a cup like shape or in an alternate embodiment a cork like shape such that forms a generally solid end cap. Arranged at or near a center point of the first end cap 18 is an orifice 22 therethrough. The orifice 22 may be of any known shape however, in one contemplated embodiment the orifice 22 has a circular shape. The first end cap 18 may be connected to and engaged with the outer surface of the body 16 or in another contemplated embodiment an inside the surface of the first end of the body 16 via either an interference or press fit or any other known mechanical or chemical fastening methodology. It is contemplated to have a snap fit securing mechanism, a threaded mechanism or chemical fastening technique such as glue, or any other known chemical fastening technique which may permanently or removably secure the first end cap 18 to the first end using the outer diameter or inner diameter of the body 16.

The rally towel apparatus 10 also may include a second end cap 20 arranged on the opposite end or second end of the body 16. The second end cap 20 generally may have a cup like shape or in an alternate embodiment a cork like solid shape. The second end cap 20 is capable of being secured on or in a second end of the body 16. The second end cap 20 may be secured to the second end of the body 16 with any known mechanical or chemical fastening methodology. In one contemplated embodiment a press or interference fit may be used, however it is also contemplated to use a lock and snap methodology, a threaded methodology, and or a gluing or other chemical fastening methodology. In one contemplated embodiment the second end cap 20 may have a ring 24 either molded or secured to at or near a center point of an outside or inside surface of the second end cap 20. The ring 24 may be arranged on the outside surface of the second end cap 20 and is capable of receiving a wrist strap 14 therethrough. It should be noted that it is also contemplated to have a ring 24 that is capable of rotating with respect to the second end cap 20 and hence the body 16 thus allowing for the wrist strap 14 to rotate independent of the rally towel apparatus body 16 thus allowing for a more clean and efficient rally towel twirling motion. It should also be noted that the wrist strap 14 may include a rotating connector thereon thus allowing for the wrist strap 14 to rotate and not the ring 24 which is arranged on a surface of the second end cap 20. It should also be noted that it is also contemplated to have an orifice at or near a center point of a second end cap 20 and a wrist strap 14 arranged through the orifice and secured via a knot or any known mechanical or chemical fastening technique with the second end cap 20 thus allowing for the wrist strap 14 to be used thereon.

The wrist strap 14 generally may have a loop therein and have an approximate length of twelve inches when laid straight. Hence, with the loop it is approximately six inches from one end of the wrist strap 14 to the opposite end of the loop and wrist strap 14. A metal clip or any other type of clip 26 may be used to connect the unfastened end to form the end of the wrist strap 14. The wrist strap 14 may also include another smaller loop attached to an end thereof which may be used to secure to the ring 24, which is attached to the outer surface of the second end cap 20 of the rally towel apparatus 10. It should be noted that the inner diameter of the second end cap 20 generally may mimic or be the same or slightly larger or smaller then the outer diameter of the body 16 of the rally towel apparatus 10 in an embodiment of the present invention. However, it is also contemplated that the outer diameter of the first and second end cap 18, 20 generally may have the same or less diameter than the inner diameter of the body 16 of the rally towel apparatus 10 thus allowing for first and second end cap 18, 20 to be inserted into each end of the body 16 and not onto the outer surface of each end of the body 16. However, either methodology may be used depending on the design and the environment in which the rally towel apparatus 10 will be used. Hence, the wrist strap 14 may be secured to the bottom or second end cap 20 to hold it securely in place. The wrist strap 14 may be used by the user of the rally towel apparatus 10 in order to secure the rally towel 12 to the users hand.

The rally towel apparatus 10 also may include a decorative holder/belt clip 28 at or near a top thereof that allows the user to easily attach the rally towel apparatus 10 to a pocket, belt or purse string. The belt clip holder 28 also may allow for the logo or insignia of a team to be arranged thereon for marketing purposes and to increase the appeal of the device to the consumer. The belt clip holder 28 may also include a connecting ring 30 that may or may not rotate with respect to the belt clip/holder 28.

The rally towel apparatus 10 also may include a cord 32 that may be attached between the holder/belt clip member 28 and the body 16 of the rally towel apparatus 10. The cord 32 may hold the rally towel 12 in place by means of a cord lock member 34. The user of the rally towel apparatus 10 may place a rally towel 12 inside the looped cord 32 and secure the towel 12 to the loop cord 32 by sliding the cord lock 34 into tight engagement via the cord 32 around an end or another portion of the towel 12. It should be noted that the cord 32 and wrist strap 14 may be made of any known material such as but not limited to a plastic, metal, composite, ceramic, natural material, rope, any known fiber, cotton, or any other known material. The wrist strap 14 and cord may also be made of any known color. The cord 32 may have an approximate length of twelve inches total and approximately six inches when folded over to form the cord loop 32.

The cord lock 34 may generally have a ball like shape with a locking button and spring arranged therein. This may allow the locking button, via a spring action, to align with an orifice though a diameter of the cord lock ball, thus allowing both portions of the loop cord 32 to be passed through the cord lock member 34. The cord lock member 34 may then engage with the cord 32 and allow the cord 32 to be secured and tightened around the rally towel 12 during use of the rally towel apparatus 10. It should be noted that any other form of a cord lock member 34 may be used with the present invention. It should also be noted that the cord lock 34 generally is made of a plastic material and the spring is made of a metal material however any other material may be used for either component therein. It should be further noted that a securing clip 36 may be connected to both ends of the looped cord 32 to form the looped cord 32 into a single structure with a single end that is passed through the orifice 32 as defined above in the first end cap 18. One end of the cord 32 of rally towel apparatus 10 of the present invention may be passed through the orifice 22 of the first end cap 18 and secured to the first end cap 18, via a knot 38 arranged in an end of the cord 32 and a washer 40 arranged between the knot 38 and an inner surface of the first end cap 18 of the rally towel apparatus 10. In one contemplated embodiment the washer 40 is a standard washer made of a plastic material that may allow for the necessary retention of the rally towel 12 with respect to the body 16 and the first end cap 18 during twirling of the rally towel 12 by the user. It should be noted that any other material may be used for the washer 40 such as any other known metal, ceramic, composite, natural material or the like. It should further be noted that it is also contemplated to mold or connect a ring to an outer surface of the first end cap 18, wherein the ring may be fixed or rotatable with respect to the end cap 18 and body 16 of the rally towel apparatus 10. It should noted that both the first end cap 18, second end cap 20 and body 16 generally are made of a plastic material however any other metal, plastic, ceramic, composite, natural or manmade material may also be used for the first and second end cap 18, 20 and the body 16 of the rally towel apparatus 10. It should be further noted that the knot 38 in the end of the cord 32 may keep the cord 32 from pulling back through the washer 40 and end cap opening 22. The washer 40 may also help reduce friction from the twirling of the towel 12 during use of the rally towel apparatus 10. Hence, the end caps 18, 20 may be secured onto the body 16 of the rally towel apparatus 10 after the belt clip, 28 cord lock 34, washer 40 and knotted cord 32 are arranged on the rally towel apparatus 10.

During operation of the rally towel apparatus 10 the user may clip the apparatus 10, using the belt clip 38, onto themselves via a belt, pant waist, purse string, or any other accessory that is being worn thus allowing for the user to display the rally towel 12 and the rally towel apparatus 10 in any number of color schemes, logos, etc. The rally towel 12 may be placed through the loop of the cord 32 and then the cord lock member 34 may be slid into engagement with the towel 12 such that the cord 32 wraps tightly around and engages the towel 12 thus securing the towel 12 in place to the rally towel apparatus 10. The rally towel apparatus 10 may have any known color scheme, sticker, or logo thereon to appeal to a wide range of sports fan rally towel 12 owners. It is further noted that the sports fan rally towel 12 may be used around the world at many different sporting venues. It may be further noted that the rally towel apparatus 10 of the present invention may allow each of the fans to carry, display and twirl their towels because of team pride and rally on their team in a new and exciting way. It should also be noted that the rally towel apparatus 10 may be marketed to sports fans around the world because it may be capable to be used at any venue from schools to professional sporting events and it could be sold in stores, online and at sporting events around the world. Hence, the light weight rally towel apparatus 10 of the present invention may allow the user to hold onto, display and secure the rally towel 12 while they are rallying their team by twirling their fan rally towel 12 without worry of losing their rally towel 12 or dropping the rally towel 12 onto the arena floor. The rally towel apparatus 10 also allows for the seller of the product to place their logo, insignia or other team rally cries onto the outer surface of the rally towel apparatus 10 for marketing purposes and in order to increase the appeal of the rally towel apparatus 10 in the end consumer.

The present description is for illustrative purposes only and it should not be construed to limit the present invention in any way. Thus, a person skilled in the art will appreciate that various modifications might be made to the present and disclosed embodiments without departing from the scope and spirit of the present invention, which is defined in terms of the claims below. Other aspects, features and advantages may be apparent upon an examination of the attached drawing figures and appended claims.

What is claimed is:

1. An apparatus for use with a towel, said apparatus comprising:

a body having a first end and a second end, said body comprising an inner bore extending from said first end to said second end;

a first end cap removably arranged on said first end of said body;

a second end cap removably arranged on said second end of said body;

a cord secured to said first end cap;

a cord lock member arranged on said cord;

a wrist strap secured to said second end cap; and a towel, wherein said cord having a loop therein, said loop receives said towel therein, and wherein at least one of said first end cap and said second end cap may be removed from said body such that said towel may be stored within said inner bore of said body when the apparatus is not in use.

2. The apparatus of claim 1 wherein said body having a generally tube like shape.

3. The apparatus of claim 1 wherein said body having a predetermined length and diameter, said body capable of receiving any known color scheme, logo, sticker, etc. on an outside surface thereof.

4. The apparatus of claim 1 wherein said first end cap having a generally cup like shape or a generally cork like shape.

5. The apparatus of claim 1 wherein said first end cap having an orifice through a surface thereof.

6. The apparatus of claim 5 wherein said cord passes through said orifice and a washer.

7. The apparatus of claim 6 wherein said cord having a knot at an end thereof.

8. The apparatus of claim 1 wherein said cord lock member is slid towards the towel to tighten and secure said cord around the towel.

9. The apparatus of claim 1 further comprising a belt clip member attached to said cord.

10. The apparatus of claim 1 wherein said second end cap having a ring attached thereto, said wrist strap is secured to said ring.

11. A fan rally apparatus, said apparatus comprising:

a body having a first end and a second end, said body comprising an inner bore extending from said first end to said second end;

a first end cap removably engaged with said first end;

a second end cap removably engaged with said second end;

a cord connected to said first end cap;

a cord lock member arranged on said cord;

a wrist strap connected to said second end cap; and a towel, wherein said cord having a loop therein, said loop receives said towel therein, and wherein at least one of said first end cap and said second end cap may be removed from said body such that said towel may be stored within said inner bore of said body when the apparatus is not in use.

12. The apparatus of claim 11 further comprising a belt clip member connected to said cord.

13. The apparatus of claim 11 wherein said body having a generally cylindrical shape.

14. The apparatus of claim 11 wherein said first end cap having an orifice arranged at or near a center point thereof.

15. The apparatus of claim 11 further comprising a washer arranged between a knot on an end of said cord and a surface of said first end cap.

16. The apparatus of claim 11 further comprising a ring connected to said second end cap, said wrist strap engaged with said ring.

17. The apparatus of claim 11 further comprising a securing clip arranged on said cord.

18. The apparatus of claim 11 wherein said body is capable of receiving any known color scheme, logo, or sticker on an outside surface thereof.

* * * * *